US007976450B2

(12) United States Patent
Endo

(10) Patent No.: US 7,976,450 B2
(45) Date of Patent: Jul. 12, 2011

(54) POST-PROCESSING APPARATUS AND RECORDING MATERIAL PROCESSING APPARATUS USED THEREWITH

(75) Inventor: Toshio Endo, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 135 days.

(21) Appl. No.: 12/393,569

(22) Filed: Feb. 26, 2009

(65) Prior Publication Data

US 2009/0221411 A1 Sep. 3, 2009

(30) Foreign Application Priority Data

Feb. 29, 2008 (JP) ..... P2008-050219

(51) Int. Cl.
*B31F 1/12* (2006.01)

(52) U.S. Cl. ..... 493/407; 493/947; 493/476; 412/1; 412/8

(58) Field of Classification Search ..... 493/407, 493/405, 476, 480, 947; 412/1, 4, 8, 9, 22, 412/30, 37
See application file for complete search history.

(56) References Cited

U.S. PATENT DOCUMENTS

| | | | | |
|---|---|---|---|---|
| 2,066,620 | A * | 1/1937 | Grammer | 281/27.3 |
| 2,068,603 | A * | 1/1937 | Grammer | 281/21.1 |
| 2,088,904 | A * | 8/1937 | Grammer | 281/15.1 |
| 5,221,112 | A * | 6/1993 | Holmberg | 281/21.1 |
| 5,868,539 | A * | 2/1999 | Rathert | 412/5 |
| 6,142,721 | A * | 11/2000 | Marsh | 412/1 |
| 6,199,851 | B1 * | 3/2001 | Latvakangas et al. | 270/58.08 |
| 6,250,867 | B1 * | 6/2001 | Gwyn et al. | 412/19 |
| 6,692,208 | B1 | 2/2004 | Watkiss et al. | |
| 7,658,584 | B2 * | 2/2010 | Yoshie et al. | 412/11 |
| 2005/0008460 | A1 | 1/2005 | Watkiss | 412/9 |
| 2007/0036638 | A1 | 2/2007 | Yoshie et al. | |

FOREIGN PATENT DOCUMENTS

| | | |
|---|---|---|
| JP | 2001-260564 | 9/2001 |
| JP | 2004-345863 | 12/2004 |
| JP | 2005-298130 | 10/2005 |
| JP | 2007-069599 | 3/2007 |
| JP | 2007-237562 | 9/2007 |

* cited by examiner

*Primary Examiner* — Sameh H. Tawfik
(74) *Attorney, Agent, or Firm* — Morgan, Lewis & Bockius LLP

(57) ABSTRACT

A post-processing apparatus, includes: a restraining unit that restrains a periphery of the back portion of the booklet; a pressing unit that presses the back portion of the booklet restrained by restraining unit so that a curved back face of the back portion of the booklet is formed into a flat back face; an expanding amount judging unit that judges the expanding amount of the booklet in a thickness direction thereof before the pressing operation by the pressing unit; and a relief amount adjusting unit that, based on the judgment result of the expanding amount judging unit, adjusts a deformation amount of the back portion of the booklet in the thickness direction thereof caused by the pressing operation of the pressing unit, the relief amount adjusting unit being located between the restraining unit and the pressing unit.

11 Claims, 14 Drawing Sheets

POST-PROCESSING APPARATUS AND RECORDING MATERIAL PROCESSING APPARATUS USED THEREWITH

CROSS-REFERENCE TO RELATED APPLICATIONS

This application is based on and claims priority under 35 USC 119 from Japanese Patent Application No. 2008-050219 filed Feb. 29, 2008.

BACKGROUND

1. Technical Field

The present invention relates to a post-processing apparatus and a recording material processing apparatus used therewith.

2. Related Art

Sheets of recording material on which images have been recorded using an image forming apparatus or the like are subjected to post-processing; for example, multiple sheets of recording material are collected, saddle-stapled or half-folded and formed into a booklet. In order that such booklets are easily stacked flat, it is known to use a system (square folding system) in which pressure is applied to the curved back face of the back portion of the booklet so that the back portion is crushed and formed into a square shape having a flat back face.

SUMMARY

According to an aspect of the invention, a post-processing apparatus for a booklet which is a bundle of half-folded sheets of recording material and of which a back portion protrudes, includes: a restraining unit that restrains a periphery of the back portion of the booklet; a pressing unit that presses the back portion of the booklet restrained by restraining unit so that a curved back face of the back portion of the booklet is formed into a flat back face; an expanding amount judging unit that judges the expanding amount of the booklet in a thickness direction thereof before the pressing operation by the pressing unit; and a relief amount adjusting unit that, based on the judgment result of the expanding amount judging unit, adjusts a deformation amount of the back portion of the booklet in the thickness direction thereof caused by the pressing operation of the pressing unit, the relief amount adjusting unit being located between the restraining unit and the pressing unit.

BRIEF DESCRIPTION OF THE DRAWINGS

Exemplary embodiment(s) of the present invention will be described in detail based on the following figures, wherein.

DETAILED DESCRIPTION

First, an outline of an exemplary embodiment model to which the present invention is applied will be described below.

Outline of Exemplary Embodiment Model

Figure 1A:
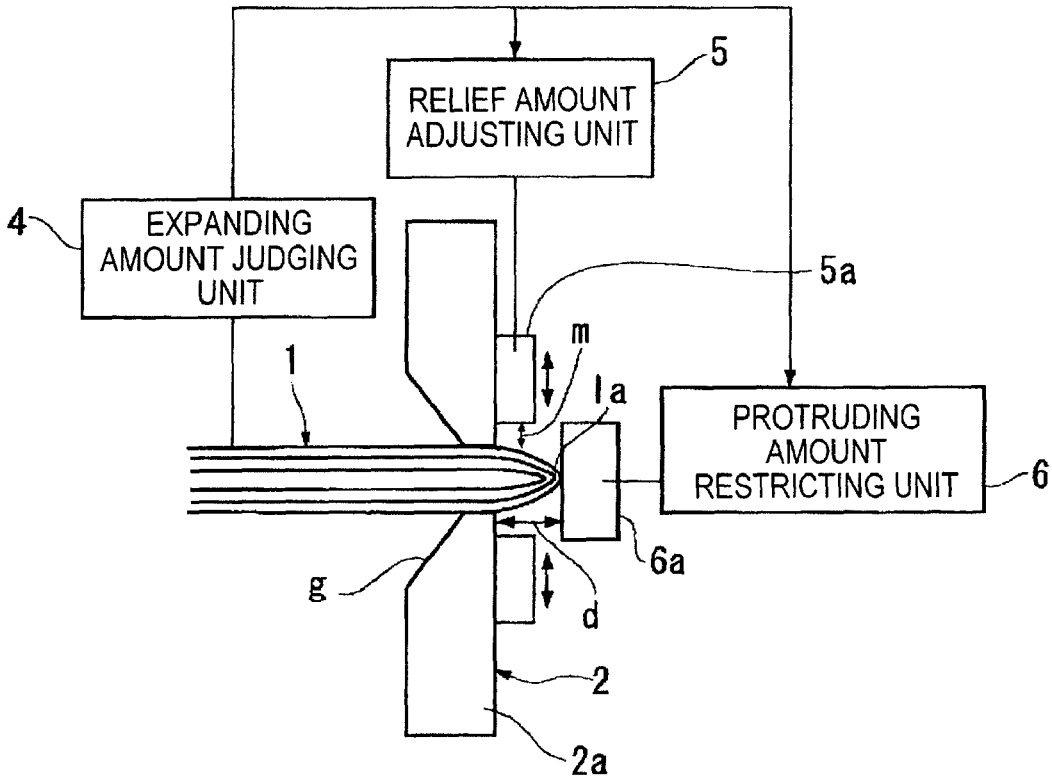
FIGS. 1A and 1B are explanatory views showing an outline of a post-processing apparatus according to an exemplary embodiment model of this exemplary embodiment.
Figure 1B:
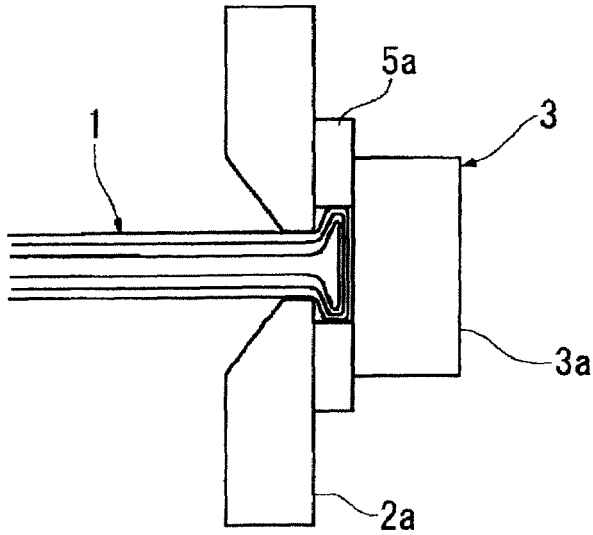

FIGS. 1A and 1B show an outline of a post-processing apparatus according to an exemplary embodiment model for embodying the present invention. As shown in FIGS. 1A and 1B, a typical model of the post-processing apparatus includes a restraining unit 2 for restraining the periphery of the back portion 1*a* of a booklet 1 which is a bundle of half-folded sheets of recording material while the back portion 1*a* protrudes; a pressing unit 3 for pressing the back portion 1*a* of the booklet 1 restrained by the restraining unit 2 so that the curved back face of the back portion 1*a* of the booklet 1 is formed into a flat back face; an expanding amount judging unit 4 for judging the expanding amount of the booklet 1 in the thickness direction thereof before the pressing operation of the pressing unit 3; and a relief amount adjusting unit 5 for restricting the deformation amount of the back portion 1*a* of the booklet 1 in the thickness direction thereof caused by the pressing operation of the pressing unit 3 and for adjusting a relief amount m serving as relief space corresponding to the deformation amount of the back portion 1*a* of the booklet 1 in the thickness direction thereof that should be restricted, on the basis of the judgment result of the expanding amount judging unit 4. FIG. 1A shows a state in which the booklet 1 is restrained, and FIG. 1B shows a state in which the back portion 1*a* of the restrained booklet 1 is pressed.

Although the booklet 1 may be half-folded (folded in two), the booklet 1 may be saddle-stapled for the purpose of forming the curved back face of the booklet 1 into a flat back face against the pressing force of the pressing unit 3 so that the back portion 1*a* is formed into a favorable square shape (square folding).

In addition, the shape or the like of the restraining unit 2 is not limited particularly, provided that the restraining unit 2 restrains the periphery of the back portion 1*a* of the booklet 1, the protruding amount d of the back portion being adjusted to a predetermined amount, so as to hold both faces of the periphery of the back portion la of the booklet 1 in the thickness direction thereof. However, the restraining unit 2 may be made of a highly rigid material, such as a metal, for the purpose of forming the back face 1*a* into a favorable square shape.

Furthermore, the pressing unit 3 may be configured so as to be able to press the back portion 1*a* of the booklet 1 restrained using the restraining unit 2. The pressing unit 3 may be configured so as to press the whole range of the back portion 1*a* of the booklet 1 at a time or may also be configured so that, for example, a roll-shaped member is used and moved along the back portion 1*a* of the booklet 1 while pressing the back portion 1*a*. However, for the purpose of easily forming the back face 1*a* of the booklet 1 into a favorable square shape, the pressing unit 3 may be configured so that a roll-shaped member made of a highly rigid material, such as a metal, is used and moved along the whole range of the back portion 1*a* while pressing the back portion 1*a* of the booklet 1 so as to form the back portion 1*a* into a square shape. Moreover, the position of the back portion 1*a* of the booklet 1 restrained using the restraining unit 2, at which the pressing unit 3 presses the back portion 1*a*, may be a position wherein the back portion 1*a* is formed into a favorable square shape. Furthermore, the position may be a position wherein the pressing unit 3 is away from the restraining unit 2 by a predetermined clearance distance or may be a position wherein the pressing unit 3 makes contact with the restraining unit 2. However, for the purpose of stabilizing the pressing force during pressure application, the pressing unit 3 may presses the back portion 1*a* of the booklet 1 in a state in which the pressing unit 3 makes contact with the restraining unit 2 (in a state in which the pressing unit 3 makes contact with relief amount adjusting members 5*a* that is described later and provided adjacent to the restraining unit 2 in this exemplary embodiment).

In addition, the expanding amount judging unit 4 may be configured so as to be able to judge the expanding amount of the booklet 1 in the thickness direction thereof before the pressing operation of said pressing unit 3. The expanding amount judging unit 4 may be configured so as to judge the expanding amount of the booklet 1 before the booklet is restrained using the restraining unit 2 or may also be configured so as to judge the expanding amount when the booklet is restrained. Furthermore, the expanding amount judging unit 4 may be configured so as to judge the expanding amount of the booklet 1 before and when the booklet is restrained. For the purpose of judging the expanding amount, the expanding amount of the booklet 1 may be detected using a detector, for example, and the judgment may be made on the basis of the obtained detection information, or the expanding amount may also be judged on the basis of information regarding the number of sheets of recording material manually input, for example.

The expanding amount judging unit 4 may be provided inside the post-processing apparatus, but may also be provided inside a pre-processing apparatus different from the post-processing apparatus so as to judge the expanding amount on the basis of information regarding the number of sheets of recording material, the quality of recording material, etc.

For the purpose of adjusting the relief amount m more, the relief amount adjusting unit 5 may have relief amount adjusting members 5*a* disposed adjacent to the restraining unit 2 and being movable along the thickness direction of the booklet, and that the positions of the relief amount adjusting members 5*a* are moved on the basis of the judgment result of the expanding amount judging unit 4. In this case, the expanding amount judging unit 4 may judge the expanding amount of the booklet 1 restrained using the restraining unit 2 or may judge the expanding amount of the booklet 1 before the booklet is restrained using the restraining unit 2. Furthermore, the above-mentioned two judgment methods may be combined, and the relief amount is adjusted once to a predetermined relief amount m on the basis of the expanding amount of the booklet 1 before the booklet is restrained, and then the relief amount m is fine-adjusted for correction on the basis of the expanding amount of the booklet 1 when the booklet is restrained, for example.

Moreover, for the purpose of securely obtaining the relief amount m stably, the restraining unit 2 may have a pair of restraining members 2*a* provided so as to hold the booklet 1 in the thickness direction thereof and that the relief amount adjusting members 5*a* are provided so as to be slidably movable along the faces of the restraining members 2*a* on the side of the back portion of the booklet among the faces of the restraining members 2*a* being nearly perpendicular to the restrained faces of the booklet.

In addition, for the purpose of further adapting the relief amount m to the expanding amount of the booklet 1, the relief amount adjusting unit 5 may adjust the relief amount m by moving the relief amount adjusting members 5*a* obliquely with respect to the vertical direction of the restrained booklet 1. With this configuration, the change in the relief amount m in the thickness direction of the booklet can be made small even if the relief amount adjusting members 5*a* are moved significantly in the vertical direction of the booklet 1. As a result, the relief amount m can be adjusted more precisely.

Furthermore, for the purpose of easily inserting the booklet 1 into the restraining position of the booklet by the restraining unit 2 when the booklet 1 is restrained using the restraining unit 2, the pair of the restraining members 2*a* of the restraining unit 2 may have guide faces g inclined so that the space therebetween becomes narrow along the insertion direction of the booklet on the side where the back portion 1*a* of the booklet 1 is inserted when the booklet is restrained using the restraining members 2*a*. The inclination angle of the guide face g is not limited particularly, and the guide face may have an angle to the extent that the insertion of the booklet 1 is not hindered when the booklet is inserted into the restraining unit 2.

Moreover, for the purpose of forming the back portion 1*a* of the booklet 1 into a favorable square shape using the pressing unit 3, the pressing unit 3 may have a roll-shaped pressing member 3*a* for pressing the back portion 1*a* of the booklet 1 located at the restraining position of the booklet so that the curved back face of the back portion 1*a* of the booklet 1 is formed into a flat back face, and that the pressing member 3*a* is moved along the back portion 1*a* of the booklet 1 while making contact with the relief amount adjusting members 5*a* or the restraining members 2*a* when the booklet 1 is pressed using the pressing member 3*a*. With this configuration, the position at which the booklet 1 is pressed using the pressing member 3*a* when the booklet is pressed can be maintained constant, and the square shape of the processed back portion of the booklet 1 becomes stable.

Besides, for the purpose of exerting proper pressure to the back portion 1*a* of the booklet 1 using the pressing unit 3, in the case that the expanding amount judging unit 4 is used to judge the expanding amount of the booklet 1 before the booklet is restrained using the restraining unit 2, the post-processing apparatus may further be equipped with protruding amount restricting unit 6 for restricting the protruding amount d of the back portion protruding from the restraining position of the booklet by the restraining unit 2 depending on the judgment result of the expanding amount judging unit 4.

In addition, for the purpose of stably attaining the protruding amount d of the back portion, the protruding amount restricting means 6 may be equipped with a protruding amount restricting member 6*a* that is provided so as to be movable along the protruding direction of the back portion 1*a* of the booklet 1 protruding from the restraining position of the booklet by the restraining unit 2, so as to be withdrawn to a position where the protruding amount restricting member 6*a* does not interfere with the pressing unit 3 when the booklet 1 is pressed using the pressing unit 3, and so as to restrict the position of the back portion 1*a* of the booklet 1 corresponding to the restraining position. In this case, the protruding amount restricting member 6*a* may be provided so as to be movable along the protruding direction of the back portion when restricting the position of the back portion 1*a* of the booklet 1. The direction of the protruding amount restricting member 6*a* when it is withdrawn from the restricted position may be any direction, provided that the protruding amount restricting member does not interfere with the pressing unit 3.

Furthermore, for the purpose of automatically inserting the booklet 1 to the position where the back portion 1*a* of the booklet 1 is restricted using the protruding amount restricting unit 6, the post-processing apparatus may further be equipped with booklet conveying unit for conveying the booklet 1 so that the booklet 1 is conveyed until the back portion 1*a* of the booklet 1 reaches the position where the back portion 1*a* of the booklet 1 is restricted using the protruding amount restricting unit 6, and that after the back portion 1*a* of the booklet 1 is struck against the protruding amount restricting member 6*a* of the protruding amount restricting unit 6 so that the position of the back portion 1*a* is restricted, the booklet conveying unit is stopped or idly operated while the back portion 1*a* of the booklet 1 is retained at the restricted position.

In addition, a recording material processing apparatus to be used with this kind of post-processing apparatus may be configured as described below. That is to say, the recording material processing apparatus includes an image forming unit for forming images on sheets of recording material, half-folding unit for collecting the sheets of recording material on which images have been formed using this image forming unit and for half-folding the sheets of recording material to obtain a booklet 1, and a post-processing apparatus for processing the back portion 1*a* of the half-folded booklet 1 so that the curved back face of the back portion 1*a* is formed into a flat back face, wherein the above-mentioned post-processing apparatus may be used as this post-processing apparatus.

The present invention will be described below in greater detail on the basis of an exemplary embodiment shown in the accompanying drawings.

Figure 2:
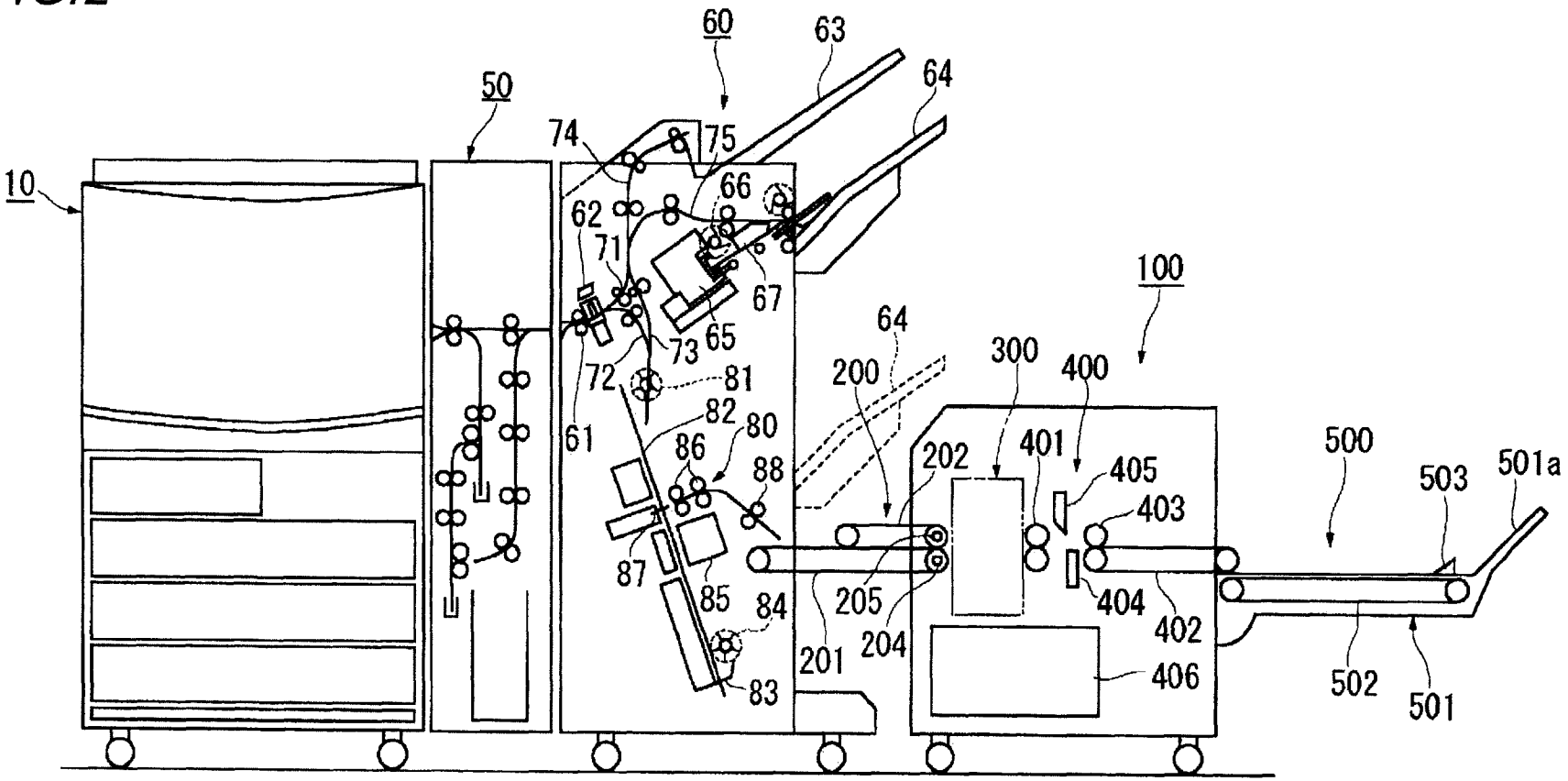
FIG. 2 is an explanatory view showing an outline of a recording material processing apparatus according to the exemplary embodiment.

FIG. 2 is a view showing an exemplary embodiment of a recording material processing apparatus to which the post-processing apparatus according to the above-mentioned exemplary embodiment model is applied. Referring to the figure, the recording material processing apparatus according to this exemplary embodiment includes a digital copier 10 serving as an image forming apparatus for forming images on sheets of recording material and multiple post-processing apparatuses 50, 60 and 100 for post-processing the sheets of recording material on which images have been formed using the digital copier 10. Numeral 50 herein designates a recording material stand-by apparatus for allowing some multiple sheets of recording material of the sheets of recording material discharged from the digital copier 10 to stand by as necessary, numeral 60 designates an additional processing apparatus (finisher) for performing additional processing, such as stapling, punching and saddle-stapling/half-folding, for the sheets of recording material, and numeral 100 designates a booklet processing apparatus for forming the back portion of the booklet processed using the additional processing apparatus 60 into a square shape.

Figure 3:
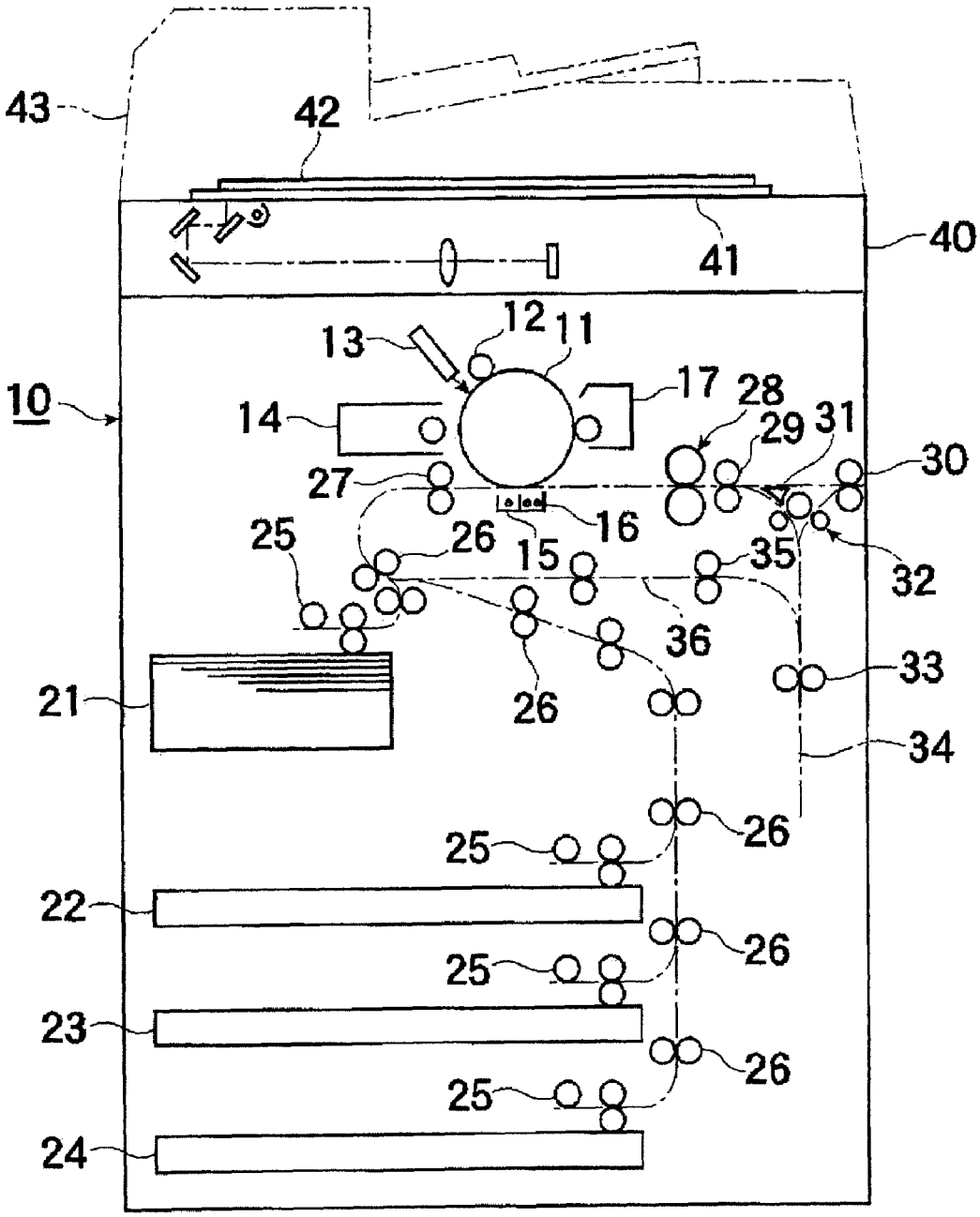
FIG. 3 is an explanatory view showing an outline of a digital copier serving as an image forming apparatus according to the exemplary embodiment.

The digital copier 10 according to this exemplary embodiment is equipped, at its upper unit, with an image reading apparatus 40 for reading an image on a manuscript 42 placed on a platen glass 41, and is provided, under this image reading apparatus 40, with an image forming unit for forming an image on a sheet of recording material, as shown in FIG. 3. In the image forming unit, a toner image is formed on a photoreceptor 11, and this toner image is transferred onto the sheets of recording material supplied from multiple recording material supply units 21 to 24 provided under the image forming unit and then fixed onto the sheets of recording material.

A charger 12, such as a charging roll, for uniformly charging the surface of the photoreceptor 11; an exposure unit 13, such as an LED array, for forming an electrostatic latent image on the charged photoreceptor 11; a developer 14 for developing the electrostatic latent image formed on the photoreceptor 11 using toner into a visible image; a transfer unit 15 of the corotron type for transferring the toner image formed on the photoreceptor 11 onto the sheets of recording material supplied from the recording material supply units 21 to 24; a cleaner 17 for cleaning the toner and the like remaining on the photoreceptor 11 after the transfer; etc. are disposed around the photoreceptor 11. In addition, numeral 16 designates a neutralization unit for separating the sheet of recording material from the photoreceptor 11 after the transfer of the toner image. Numeral 43 designates an automatic manuscript feeder, serving as an optional unit, for feeding the manuscript 42 onto the platen glass 41, the feeder being indicated using alternate long and two short dashed lines.

The recording material conveying system inside the digital copier 10 is configured as described below. Supply rolls 25 for supplying the sheets of recording material from the recording material supply units 21 to 24 are provided near the recording material supply units 21 to 24. The sheets of recording material supplied using these supply rolls 25 are conveyed using conveying rolls 26 and the like disposed appropriately and fed to registration rolls 27 provided at positions adjacent to each other on the upstream side in the direction of conveying the sheets of recording material from the transfer position wherein the photoreceptor 11 and the transfer unit 15 are opposed to each other. These registration rolls 27 restrict the position of each conveyed sheet of recording material once and then convey it to the transfer position at a predetermined timing.

Furthermore, the sheet of recording material onto which the unfixed toner image has been transferred at the transfer position is conveyed to a fixing unit 28, and the unfixed toner image on the sheet of recording material is fixed using the fixing unit 28 by heating and pressure application, for example. The sheet of recording material on which the toner image has been fixed is fed to discharge rolls 30 from the outlet rolls 29 of the fixing unit 28 and discharged from the digital copier 10.

When images are formed on both side of the sheet of recording material, the conveying direction of the sheet of recording material having passed through the outlet rolls 29 of the fixing unit 28 is changed downward in the figure using a turnover gate 31, and the sheet of recording material is fed to a turnover conveying passage 34 via a three-roll unit 32 comprising three rolls disposed in pressure contact with one another and turnover rolls 33 capable of performing turnover operation. The sheet of recording material having reached the turnover conveying passage 34 is conveyed to a return conveying passage 36 provided with conveying rolls 35 by virtue of the turnover operation of the turnover rolls 33 under the condition that the trailing end of the recording member is held between the turnover rolls 33. The sheet of recording material having been conveyed to the return conveying passage 36 passes through the registration rolls 27 again, a new toner image is formed on the back side of the sheet of recording material at the transfer position, and image fixing is performed again using the fixing unit 28. The sheet of recording material on which the fixing has been performed passes through the outlet rolls 29 and the discharge rolls 30 and is discharged from the digital copier 10.

The sheets of recording material on which images have been formed using the digital copier 10 are fed to the recording material stand-by apparatus 50 and conveyed to the subsequent apparatus, that is, the additional processing apparatus 60, at a predetermined timing as shown in FIG. 2.

Conveying rolls 61 for receiving and conveying the sheets of recording material from the recording material stand-by apparatus 50 are provided at the inlet of the additional processing apparatus 60 according to this exemplary embodiment. A puncher 62 for punching the sheets of recording material is provided immediately after the conveying rolls 61.

The passage for conveying the sheets of recording material on the downstream side of the puncher 62 inside the additional processing apparatus 60 is configured as described below. On the downstream side of the puncher 62, the conveying passage branches off to an upper conveying passage 71 and a lower conveying passage 72. The upper conveying passage 71 further branches off to a conveying passage 74 for directly feeding the sheets of recording material to a recording material discharging unit 63 provided above the additional processing apparatus 60 and to a conveying passage 75 for feeding the sheets of recording material to a recording material discharging unit (the so-called offset catch tray) 64, being movable and provided on the side of the additional processing apparatus 60, after edge stapling processing for stapling the end portions of the sheets of recording material are performed. On the other hand, the lower conveying passage 72 having branched off downward from the puncher 62 feeds the sheets of recording material to a saddle-stapling unit 80 (described later) for forming multiple sheets of recording material into a booklet. A conveying passage 73 for turning over and feeding the sheets of recording material to the saddle-stapling unit 80 is provided behind the conveying passages 71 and 72. In addition, conveying members (conveying rolls, guiding members, etc.) for conveying the sheets of recording material to the respective conveying passages 71 to 75 are disposed appropriately.

The edge stapling processing according to this exemplary embodiment is performed using a stapler 65. For this purpose, a paddle-equipped conveying member 66 and a tamper 67 for returning and conveying the sheets of recording material so that multiple sheets of recording material fed to the conveying passage 75 are aligned on the side of the stapler 65 with reference to the trailing ends of the multiple sheets of recording material. As a result, a bundle of the multiple sheets of recording material aligned using the paddle-equipped conveying member 66 and the tamper 67 is bound at its end using the stapler 65 and discharged to the recording material discharging unit 64. The recording material discharging unit 64 is moved downward automatically as the number of the bundles of the sheets of recording material to be discharged increases.

The saddle-stapling unit 80 is equipped with a recording material aligning tray 82 provided in an obliquely inclined state. On the upstream side thereof, a paddle-equipped conveying member 81 for feeding the sheets of recording material to the recording material aligning tray 82 is provided. In addition, at the lower end portion of the recording material aligning tray 82, an end guide 83 for positioning the lower end positions (more specifically, the leading end positions of the sheets of recording material in the traveling direction thereof) of the sheets of recording material at a predetermined position are provided so as to be movable in the up/down direction of the recording material aligning tray 82. Furthermore, near this end guide 83, a paddle-equipped conveying member 84 for arranging the sheets of recording material is provided.

Moreover, on the upper end side of the recording material aligning tray 82, a tamper (not shown) for aligning the bundle of the sheets of recording material arranged on the recording material aligning tray 82 in the width direction of the bundle is provided. The sheets of recording material fed from the conveying passage 72 to the saddle-stapling unit 80 are passed through the paddle-equipped conveying member 81, aligned for every predetermined number of sheets of recording material on the recording material aligning tray 82, and eventually formed into bundles of the sheets of recording material.

Besides, in the saddle-stapling unit 80, a saddle-stapling saddle stapler 85 for saddle-stapling the bundle of the sheets of recording material arranged on the recording material aligning tray 82 is provided. Above this saddle stapler 85, a knife edge 87 for half-folding the saddle-stapled bundle of the sheets of recording material is provided so as to be able to advance to a position opposed to half-folding rolls 86. Hence, saddle-stapling is performed using the saddle stapler 85 by moving the end guide 83 with respect to the bundle of the sheets of recording material arranged using the recording material aligning tray 82. Furthermore, the saddle-stapled and half-folded bundle (booklet) of the sheets of recording material is discharged via discharging rolls 88 from the half-folding rolls 86 while the half-folded back portion thereof is oriented ahead by advancing the knife edge 87 toward the half-folding rolls 86.

The booklet formed using the saddle-stapling unit 80 as described above is conveyed to the subsequent apparatus, that is, the booklet processing apparatus 100.

The booklet processing apparatus 100 according to this exemplary embodiment includes a conveying unit 200 for conveying the booklet discharged from the saddle-stapling unit 80 while correction for oblique traveling is performed so that the back portion of the booklet is aligned at a predetermined position at which the back portion is positioned; a square folding unit 300 for forming the back portion of the booklet having been conveyed using the conveying unit 200 into a square shape; a trimming unit 400 for trimming the edge of the booklet processed using the square folding unit 300 so that the shape of the edge is properly formed; and a booklet accommodating unit 500 for accommodating the booklet, the external appearance of which has been improved using the trimming unit 400.

The conveying unit 200 comprises a lower belt 201, capable of circulating, for receiving the booklet discharged from the discharging rolls 88 of the saddle-stapling unit 80 and for conveying the booklet to the downstream side; and an upper belt 202 provided in combination with the lower belt 201, wherein the booklet conveyed using the lower belt 201 is further conveyed between the two belts and fed to the square folding unit 300. Each of the lower belt 201 and the upper belt 202 is formed of two stretched belt elements. The belts convey the booklet while maintaining the booklet in a nearly horizontal state. When the position of the back portion of the booklet is restricted using the square folding unit 300 and the conveying of the booklet is stopped, torque limiters 204 and 205 (only two torque limiters are shown in the figure) disposed on the belt pulleys of the lower belt 201 and the upper belt 202 on the side of the square folding unit 300 are idly rotated so that the oblique traveling of the booklet is corrected. Hence, even if the booklet conveyed to the conveying unit 200 travels obliquely, correction can be performed so that the booklet has an attitude conforming to the positional restriction in the square folding unit 300.

In addition, the square folding unit 300 includes a restraining unit for receiving the booklet that has been conveyed using the conveying unit 200 while the back portion thereof is oriented ahead and for restraining the periphery of the back portion of the booklet while the booklet has a predetermined attitude in which the back portion thereof protrudes; a pressing unit for pressing the back portion of the booklet restrained using the restraining unit so that the curved back face of the back portion is formed into a flat back face; an expanding amount judging unit for judging the expanding amount of the booklet in the thickness direction thereof before the pressing operation of the pressing unit; a relief amount adjusting unit for adjusting a relief amount in the thickness direction of the booklet so that relief space corresponding to the deformation amount of the back portion of the booklet in the thickness direction thereof caused owing to the pressing operation of the pressing unit is formed, on the basis of the judgment result of the expanding amount judging unit; and a protruding amount restricting unit for restricting the protruding amount of the back portion protruding from the restraining position of the booklet by the restraining unit on the basis of the judgment result of the expanding amount judging unit. In this exemplary embodiment, the relief amount adjusting unit is integrated with the restraining unit.

Figure 4:
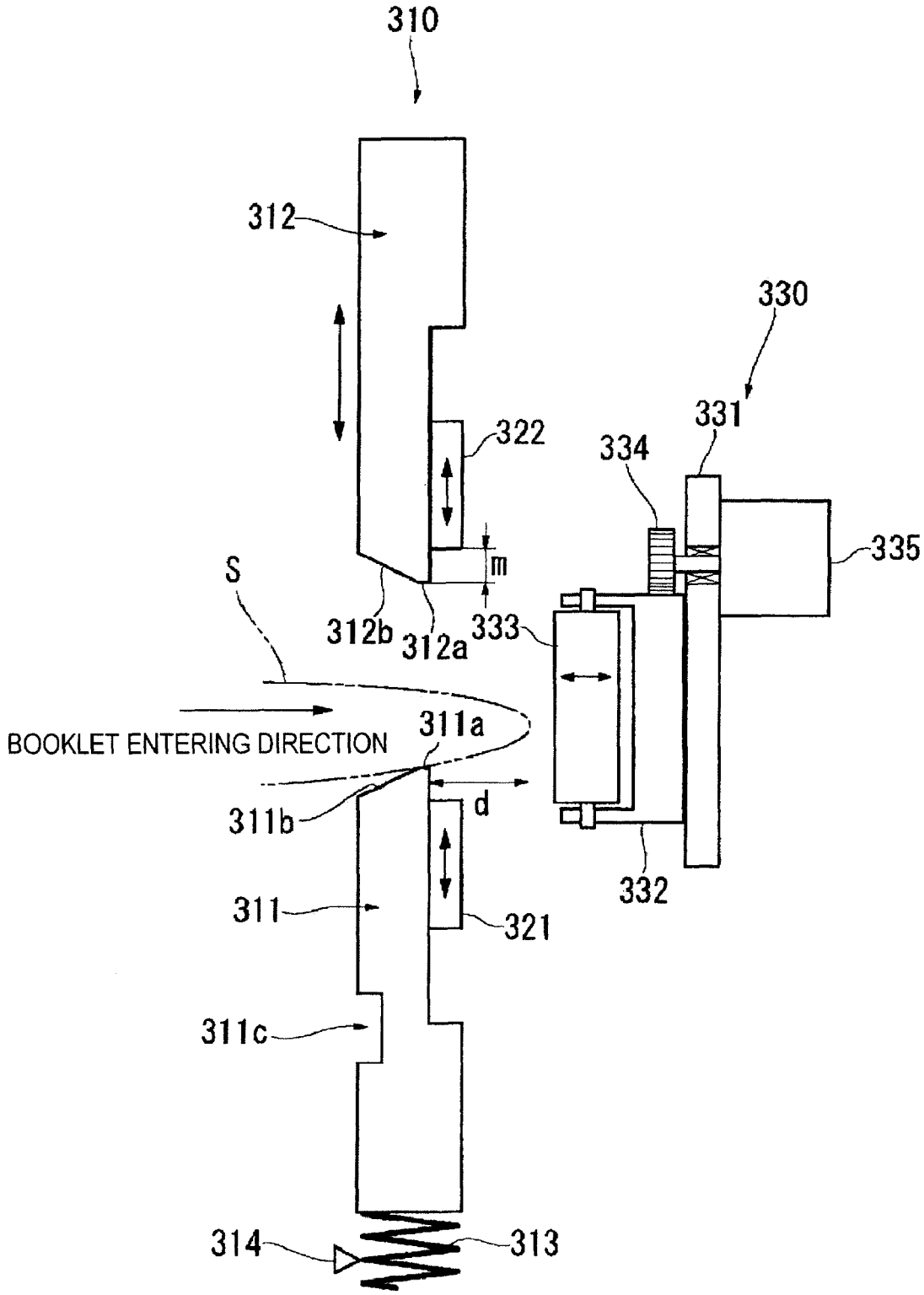
FIG. 4 is an explanatory view showing an outline of a restraining unit and a protruding amount restricting unit according to the exemplary embodiment.

As shown in FIG. 4, the restraining unit 310 of this exemplary embodiment includes a pair of dampers (a lower damper 311 and an upper damper 312), made of, for example, a metal, for restraining the periphery of the back portion of a booklet S in the vertical direction of the booklet S while the back portion of the booklet S protrudes a predetermined amount; and a restraining mechanism (not shown) for restraining the booklet S at a predetermined timing after the back portion of the booklet S has passed through between these dampers 311 and 312. On the sides of the faces making contact with the booklet to be entered, the dampers 311 and 312 have restraining faces 311*a* and 312*a* for restraining the booklet and have guide faces 311*b* and 312*b* inclined so that the space therebetween becomes narrow toward the restraining faces 311*a* and 311*b*, respectively, whereby when the booklet is entered into the restraining unit 310, the expansion or the like of the booklet does not prevent the booklet from being entered into the restraining unit 310. Numeral 330 designates a protruding amount restricting unit (described later) for restricting the position of the back portion (the protruding amount of the back portion) protruding from the clampers 311 and 312 while the booklet is restrained using the dampers 311 and 312.

Furthermore, the lower damper 311 according to this exemplary embodiment is provided with a concave portion 311*c* on the side of the booklet entering face thereof, and a biasing member 313 is provided on the side of the lower end thereof to exert an upward biasing force at all times. Moreover, for example, a potentiometer 314 capable of detecting the movement amount of the lower damper 311 is provided near the lower clamper 311. On the other hand, the upper clamper 312 is provided with a damper moving mechanism (not shown) for moving the upper damper 312 in the vertical direction. When the booklet is restrained between the two clampers 311 and 312, the upper damper 312 is moved downward so as to hold the booklet by exerting a predetermined pressing force. This pressing force presses the biasing member 313 of the lower damper 311 downward via the booklet. At this time, the movement amount of the biasing member 313 is different depending on the thickness of the booklet (the expanding amount of the booklet being changeable depending on the number of sheets of recording material and the type of recording material). The movement amount is detected using the potentiometer 314.

In addition, the lower damper 311 and the upper clamper 312 according to this exemplary embodiment are provided with relief amount adjusting members 321 and 322 that are slidable along the dampers 311 and 312 in regions near the restricting faces 311*a* and 312*a* on the opposite sides of the booklet entering faces of the upper and lower dampers 311 and 312, respectively; the relief amount adjusting members 321 and 322 are used to restrict the relief space for the back portion of the booklet that is deformed when the back portion of the restrained booklet is formed into a square shape. In order that these relief amount adjusting members 321 and 322 are slidably movable along the dampers 311 and 312, the relief amount adjusting members 321 and 322 are each equipped with a moving mechanism for moving the adjusting members in the arrow-indicated directions in the figure, thereby being capable of adjusting the relief amount m suited for the booklet.

Figure 5:
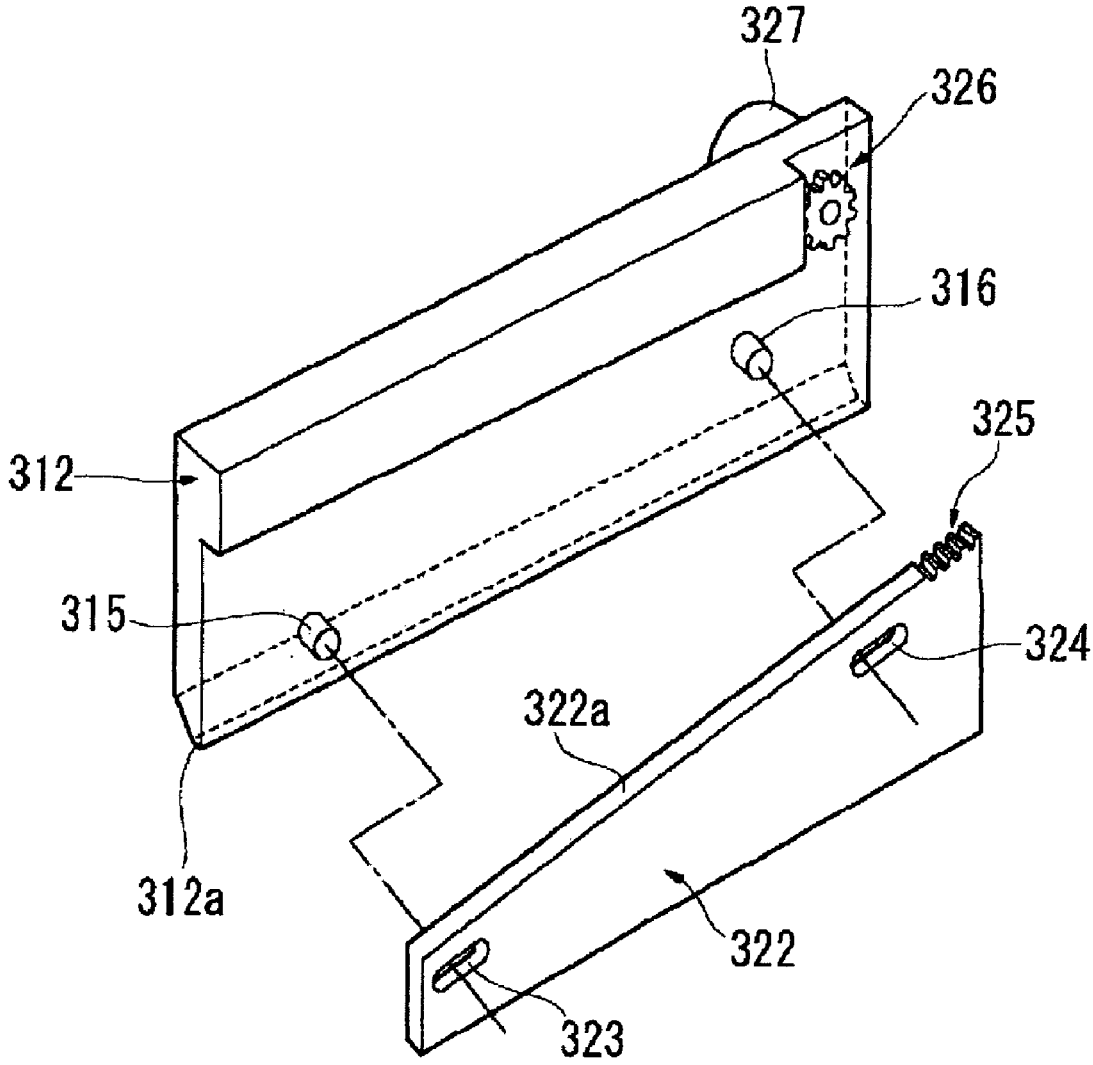
FIG. 5 is an explanatory view showing the movement mechanism of a relief amount adjusting member according to the exemplary embodiment.

FIG. 5 is a schematic view showing this moving mechanism. The moving mechanism on the side of the upper clamper 312 is herein taken as an example and the configuration thereof is shown. However, it is needless to say that the moving mechanism on the side of the lower damper 311 has a similar configuration.

In the figure, the upper damper 312 is provided with guide pins 315 and 316 at two positions in a region in which the relief amount adjusting member 322 is disposed; the heights of the two guide pins from the restraining face 312*a* are different from each other. On the other hand, the relief amount adjusting member 322 is provided with oval holes 323 and 324 extending in the direction of the straight line drawn between the guide pins 315 and 316 at the positions corresponding to the positions of the guide pins 315 and 316. In addition, a rack 325 is formed on one end side of the upper face 322*a* of the relief amount adjusting member 322. Furthermore, at the position corresponding to this rack 325 on the side of the upper damper 312, a pinion 326 to be engaged with the rack 325 is installed on the shaft of a motor 327 fixed to the upper damper 312.

Hence, when the pinion is rotated, the rack 325 of the relief amount adjusting member 322 is moved. As a result, the relief amount adjusting member 322 is moved in the direction of the straight line drawn between the guide pins 315 and 316 (moved obliquely with respect to the restricting face 312*a*), whereby the distance between the relief amount adjusting member 322 and the restricting face 312*a* (corresponding to the relief amount m) can be changed. Since the relief amount adjusting member 322 is moved obliquely at this time, the relief amount m can be set to a small amount with respect to the movement amount of the rack 325. For this reason, the relief amount m can be adjusted more precisely.

Furthermore, the protruding amount restricting unit 330 restricts the protruding amount d of the back portion of the booklet from the clampers 311 and 312 as shown in FIG. 4. The protruding amount restricting unit 330 according to this exemplary embodiment comprises a frame 331; a slider 332 provided so as to be slidable along this frame 331; a stopper 333 that is moved in the arrow-indicated directions in the figure by the movement of the slider 332 so as to be set at a predetermined position and to make contact with the back portion of the booklet, thereby restricting the protruding amount d of the back portion; a pinion 334 for moving the slider 332 in the vertical direction of the booklet; and a motor 335 for rotating this pinion 334; etc. It is herein needless to say that the substantial protruding amount of the back portion is equal to the distance from the relief amount adjusting members 321 and 322 to the stopper 333.

Figure 6:
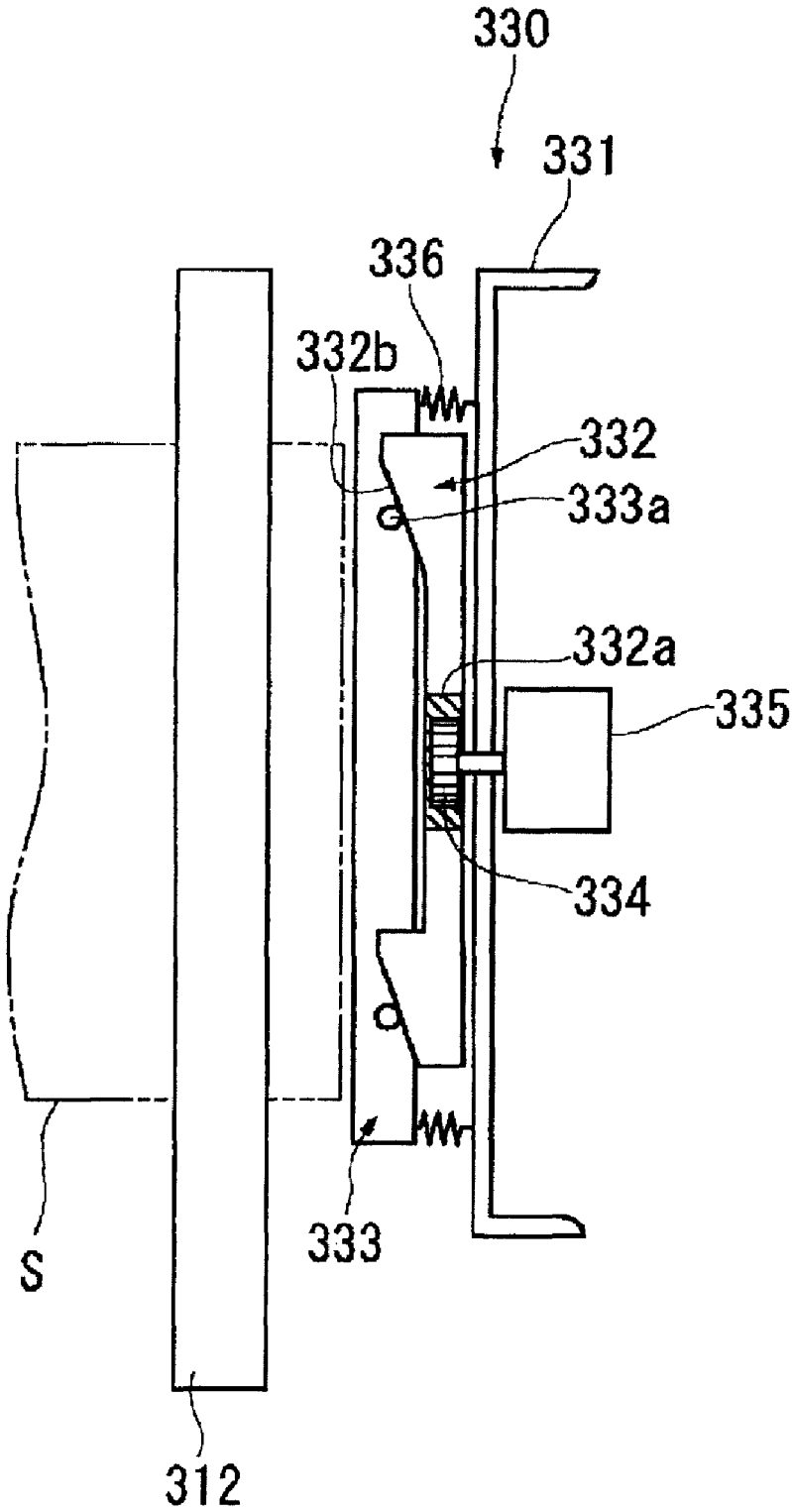
FIG. 6 is an explanatory view showing a protruding amount restricting unit according to the exemplary embodiment.

FIG. 6 shows an outline of the protruding amount restricting unit 330 seen from above. The stopper 333 of the protruding amount restricting unit 330 according to this exemplary embodiment is installed to the frame 331 via springs 336 at multiple positions. In addition, guide pins 333*a* are provided at two positions on the upper and lower faces of the stopper 333, respectively. On the other hand, the slider 332 is provided with a rack 332*a* formed on the face thereof corresponding to the pinion 334. Furthermore, in the regions corresponding to the guide pins 333*a* of the stopper 333, the slider 332 is provided with inclined units 332*b* inclined with respect to the direction of booklet insertion toward the damper 312.

In the protruding amount restricting unit 330 configured as described above, the pinion 334 is rotated by the rotation of the motor 335, whereby the rack 332*a* of the slider 332 is moved and the slider 332 slides along the frame 331. The inclined units 332*b* of the slider 332 are also moved by the movement of the slider 332, whereby the guide pins 333*a* of the stopper 333 are moved by the movement of the inclined units 332*b*. As a result, the stopper 333 can be moved along the movement direction of the booklet S. Since the stopper 333 is moved to a predetermined position as described above and the booklet S is struck against the stopper 333, the position of the back portion of the booklet S can be adjusted to a position suited for the booklet S.

At this time, since the slider 332 is moved along the vertical direction of the booklet, the inclined units 332*b* move the guide pins 333*a*. As a result, the stopper 333 is moved toward the damper 312. Hence, the movement amount of the stopper 333 can be set smaller than that of the slider 332. For this reason, the stopper 333 can be adjusted precisely.

Furthermore, in this exemplary embodiment, the position of the back portion of the booklet is restricted using the protruding amount restricting unit 330. After the booklet is restrained using the damper 312, the protruding amount restricting unit 330 is withdrawn directly downward as a whole (for example, toward the lower position in FIG. 4).

Figure 7:
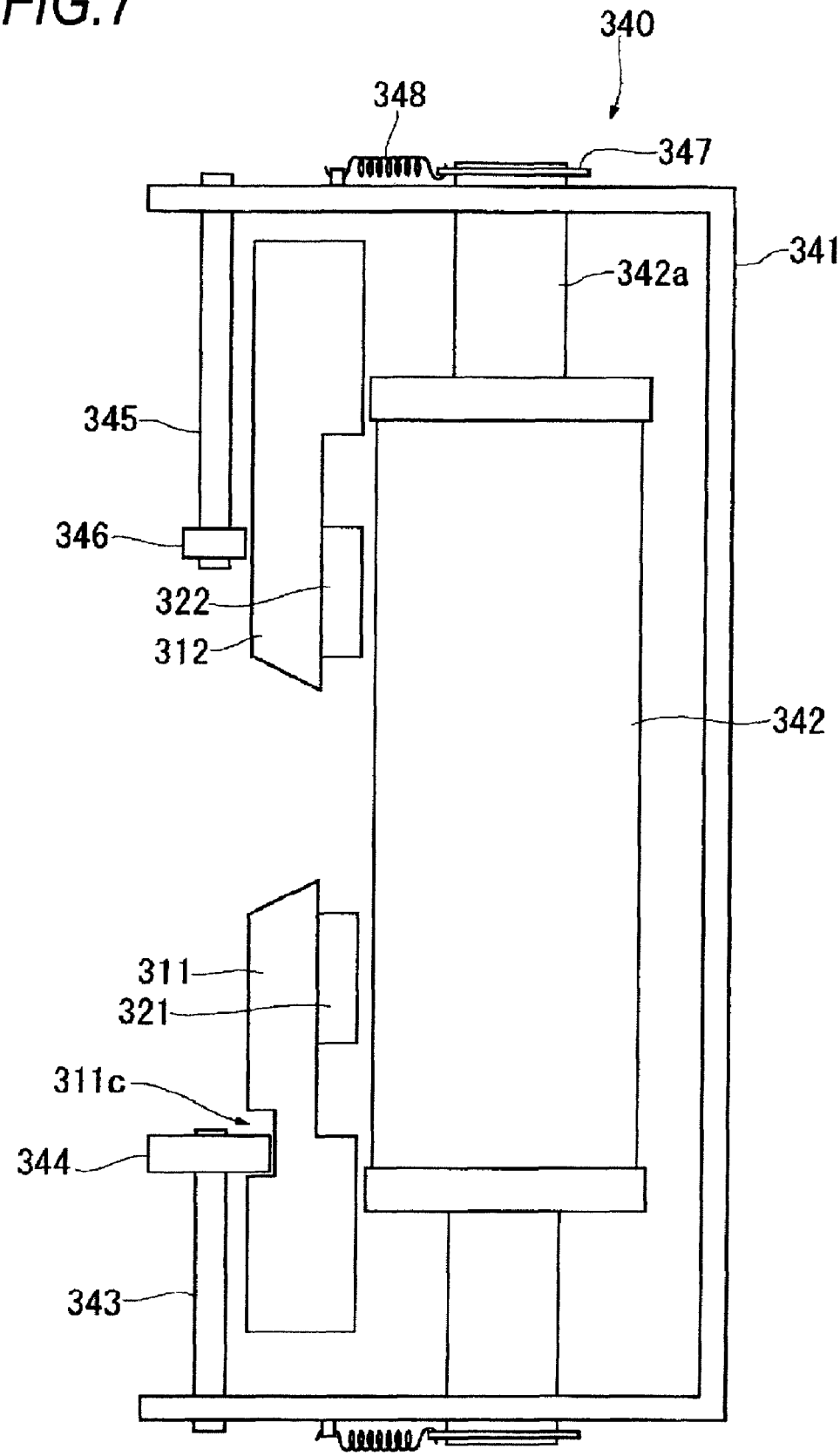
FIG. 7 is an explanatory view showing a pressing unit according to the exemplary embodiment.

Moreover, the pressing unit 340 of this exemplary embodiment is provided so as to mount on the two clampers 311 and 312 as shown in FIG. 7. While the protruding amount restricting unit 330 operates, the pressing unit 340 is disposed at a position where the pressing unit 340 does not interfere with the protruding amount restricting unit 330 on one end sides of the clampers 311 and 312. Then, the protruding amount d of the back portion is set to a predetermined amount (predetermined position) using the protruding amount restricting unit 330. After the protruding amount restricting unit 330 is withdrawn downward from the booklet restrained using the restraining unit 310, the pressing unit 340 is moved along the vertical direction of the restrained booklet, whereby the back portion of the booklet is processed so as to be formed into a square shape.

FIG. 7 shows an outline of the configuration of the pressing unit 340. A pressing roll 342 for making direct contact with the back portion of the booklet and for crushing the back portion is provided inside a frame 341 formed into a nearly U-shape. The rotation shaft 342*a* of the pressing roll 342 is inserted into slots (not shown) provided in the frame 341 at two upper and lower positions so as to be slightly movable along the left-right direction in the figure. Hence, the pressing roll 342 exerts a predetermined pressing force so as to bias the dampers 311 and 312 at all times by fitting, for example, an E-ring 347, on each of the end units of the rotation shaft 342*a* and by installing a spring 348 between one end of each E-ring 347 and the frame 341.

Moreover, rotation shafts 343 and 345 are installed near the side end of the frame 341 on the sides of the dampers 311 and 312 so as to be rotatable. Bearings 344 and 346 are installed near the end units of these rotation shafts 343 and 345. The bearing 344 on the side of the lower damper 311 is provided so as to be fitted in the concave portion 311*c* of the lower damper 311 so that the bearing 344 is movable along this concave portion 311*c*. On the other hand, the bearing 346 on the side of the upper damper 312 is movable along the side face of the upper damper 312.

In the pressing unit 340 configured as described above, when the booklet is restrained, the upper damper 312 is moved downward. However, since the bearing 346 and part of the pressing roll 342 slide along the side faces of the upper damper 312, no problem occurs particularly. Furthermore, even if the lower damper 311 is moved downward slightly after the booklet is restrained, since the concave portion 311*c* of the lower damper 311 is wider than the width of the bearing 344, no problem occurs particularly.

Moreover, after the booklet is restrained and the protruding amount restricting unit 330 (for example, shown in FIG. 6) is withdrawn downward, the pressing unit 340 is wholly moved in the vertical direction of the booklet, whereby the curved back face of the back portion of the restrained booklet can be formed into a flat back face. The movement of the pressing unit 340 along the vertical direction of the booklet can be attained, for example, by installing a ball screw on the frame 341 and by rotating a grooved rod so that this ball screw is moved along the grooved rod. Although the diameter of both end units of the pressing roll 342 is larger than that of the inner unit thereof in FIG. 7, the present invention is not limited to this configuration, and the diameter of the end units may be the same as that of the inner unit. Moreover, the length of the pressing roll 342 including both end units thereof may be equal to a length extending between the relief amount adjusting members 321 and 322.

Figure 8:
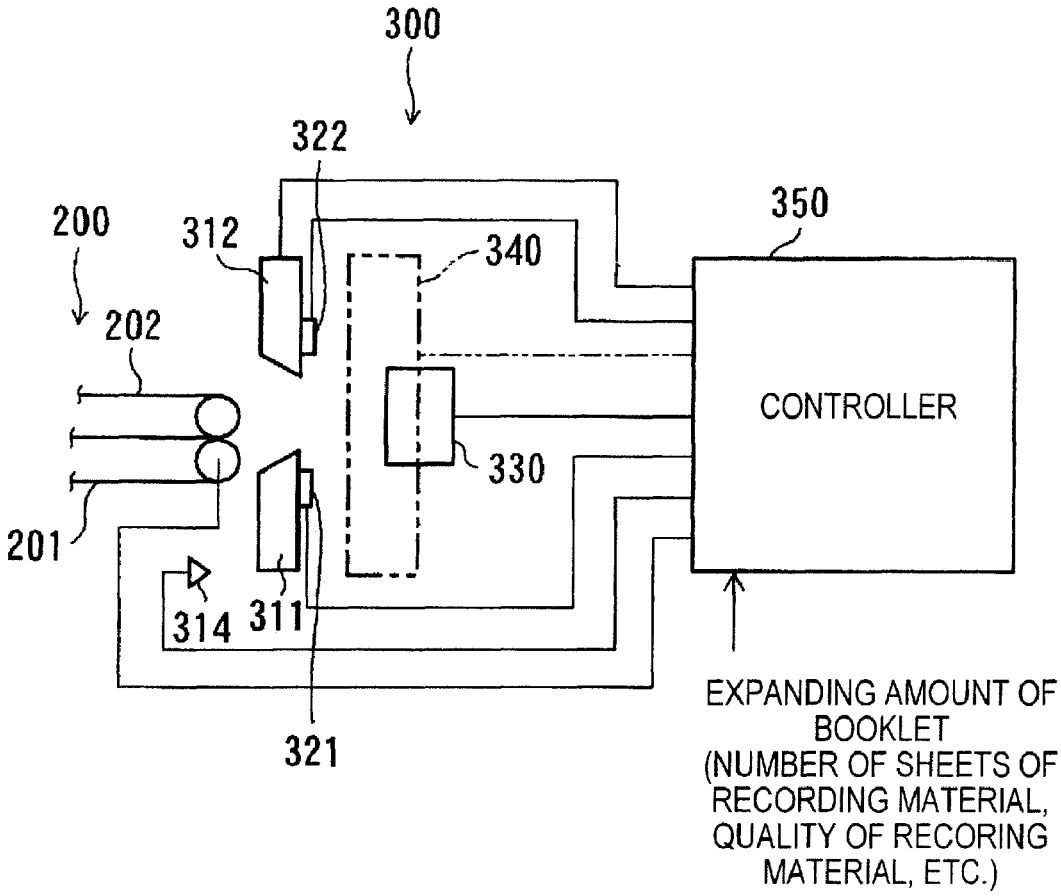
FIG. 8 is an explanatory view showing the control system of a square folding unit according to the exemplary embodiment.

Next, how the square folding unit 300 configured as described above is controlled will be described below. As shown in FIG. 8, the square folding unit 300 according to this exemplary embodiment is drive-controlled using a controller 350. This controller 350 is also used to control the conveying unit 200.

More specifically, for the purpose of determining the expanding amount of the booklet, the controller 350 controls, for example, the movement of the upper damper 312, the movement of the two relief amount adjusting members 321 and 322, the adjustment of the protruding amount restricting unit 330, the driving timing of the pressing unit 340 and the stopping timing of the conveying unit 200 on the basis of information regarding the number of sheets of recording material, the quality of recording material, etc. bundled so as to be formed into a booklet and information regarding the displacement amount of the lower damper 311 detected using the potentiometer 314

Figure 9:
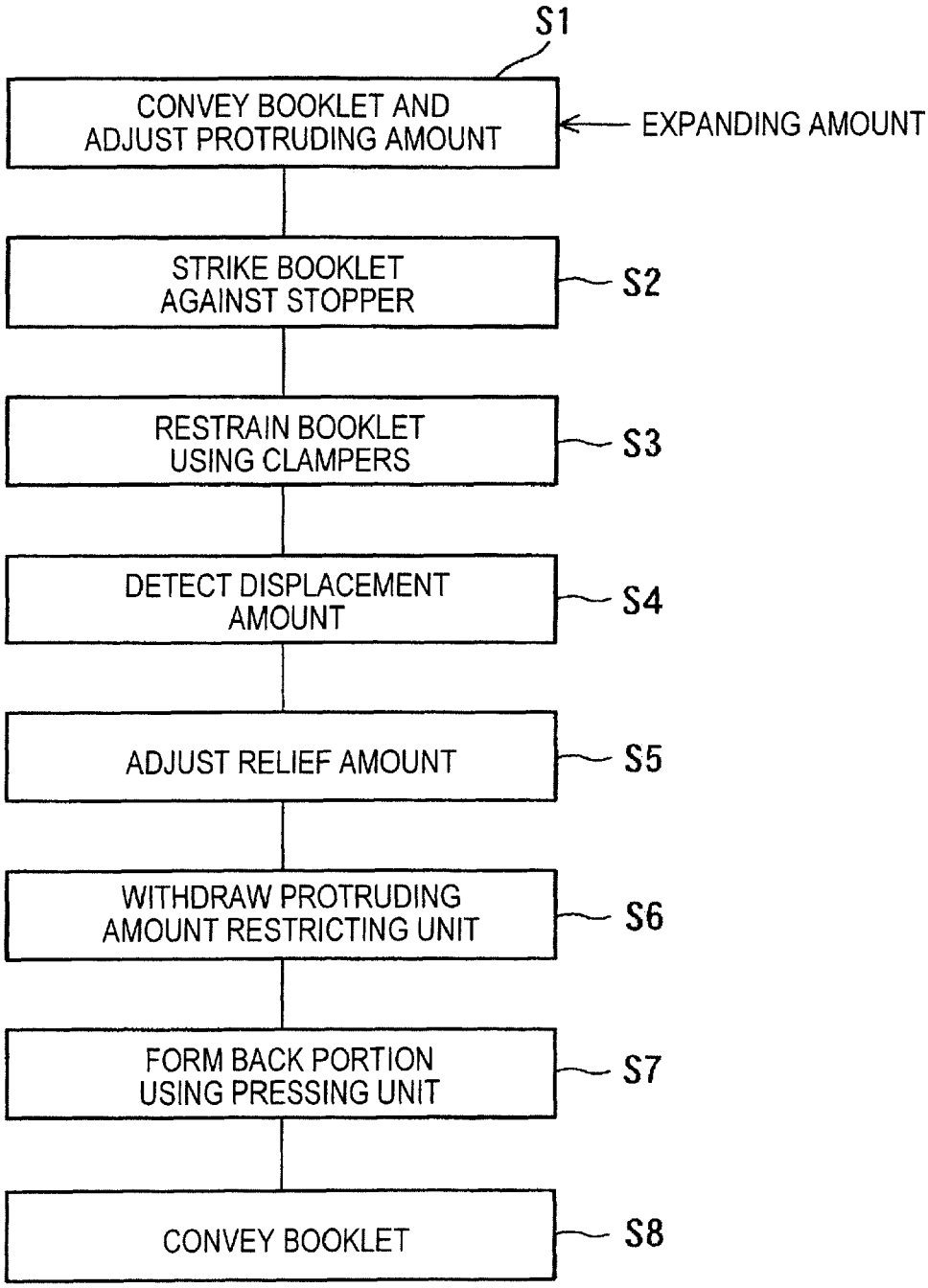
FIG. 9 is a flowchart showing processing performed in the square folding unit.

The square folding processing to be performed using the controller 350 configured as described above will be described below referring to the flowchart shown in FIG. 9.

First, the booklet is conveyed using the conveying unit 200 toward the square folding unit 300 while the back portion of the booklet is oriented ahead. In the square folding unit 300, the expanding amount of the booklet is judged on the basis of information regarding the number of sheets of recording material, the quality of recording material, etc., the position of the stopper 333 of the protruding amount restricting unit 330 is adjusted (the protruding amount of the back portion is adjusted), and the position of the back portion of the booklet to be restrained using the dampers 311 and 312 is determined (at step S1). The booklet is conveyed using the conveying unit 200 so that the back portion thereof is struck against the stopper 333 of the protruding amount restricting unit 330 that has determined the position of the back portion of the booklet (more specifically, the position of the back portion is determined by the position of the stopper 333), and the conveying unit 200 is stopped after the back portion of the booklet is aligned against the stopper 333 (at step S2). Next, the upper damper 312 is lowered so as to restrain the booklet between the upper and lower dampers 312 and 311 while the booklet is held in the conveying unit 200 (at step S3). At this time, the lower damper 311 is lowered a predetermined amount, and this displacement amount (lowering amount) of the lower damper 311 is detected using the potentiometer 314 (at step S4). The relief amount adjusting members 321 and 322 are moved on the basis of the expanding amount of the booklet corresponding to the detected displacement amount to adjust a relief amount (relief space) depending on the restrained booklet (at step S5). Then, the protruding amount restricting unit 330 is wholly withdrawn (at step S6), and the pressing unit 340 is moved to form the back portion of the booklet into a flat shape (at step S7). The booklet, the back portion of which is flattened, is conveyed to the trimming unit 400 on the downstream side by starting the conveying unit 200 (at step S8).

Next, the booklet, the back portion of which has been formed into a flat shape as described above, is conveyed toward the trimming unit 400. As shown in FIG. 2, the trimming unit 400 is provided with inlet rolls 401 for receiving the booklet on the inlet side thereof and is equipped with a conveying unit comprising a belt roll 402 having a driving unit (not shown) and a conveying roll 403 to be driven so as to be rotated on the downstream side. A cutter is provided between these to trim the booklet. The cutter is composed of a lower blade 404 being fixed and an upper blade 405 that lowers along one end side of the lower blade 404. The booklet is trimmed by lowering the upper blade 405. Numeral 406 in the figure designates a cut waste collection unit for collecting cut waste generated when the booklet is trimmed.

In other words, the booklet, the back portion of which is formed into a square shape using the square folding unit 300, is conveyed from the inlet rolls 401 to the space between the belt roll 402 and the conveying roll 403 of the conveying unit so as to be held therebetween. After the booklet is conveyed for a predetermined time, the belt roll 402 is stopped while part of the booklet is held between the belt roll 402 and the conveying roll 403, and the upper blade 405 of the cutter is lowered, whereby the edge of the booklet is trimmed. The booklet, the edge of which has been trimmed, is directly conveyed toward the booklet accommodating unit 500 as the belt roll 402 is rotated.

As shown in FIG. 2, the booklet accommodating unit 500 comprises a support frame 501, a belt roll 502 supported using the support frame 501 and a detector 503 for detecting whether the booklet is accommodated. At this time, the belt roll 502 is disposed at a position wherein the booklet, whose edge has been trimmed using the trimming unit 400 and which has been conveyed using the belt roll 402 of the trimming unit 400 while the back portion thereof is oriented ahead, can drop directly.

Figure 10A:
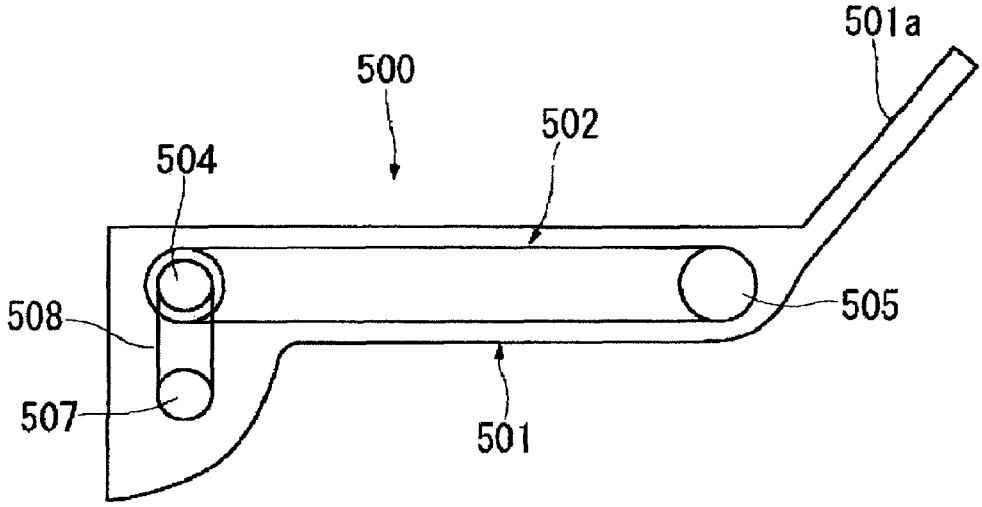
FIGS. 10A and 10B are explanatory views showing an outline of a booklet accommodating unit.
Figure 10B:
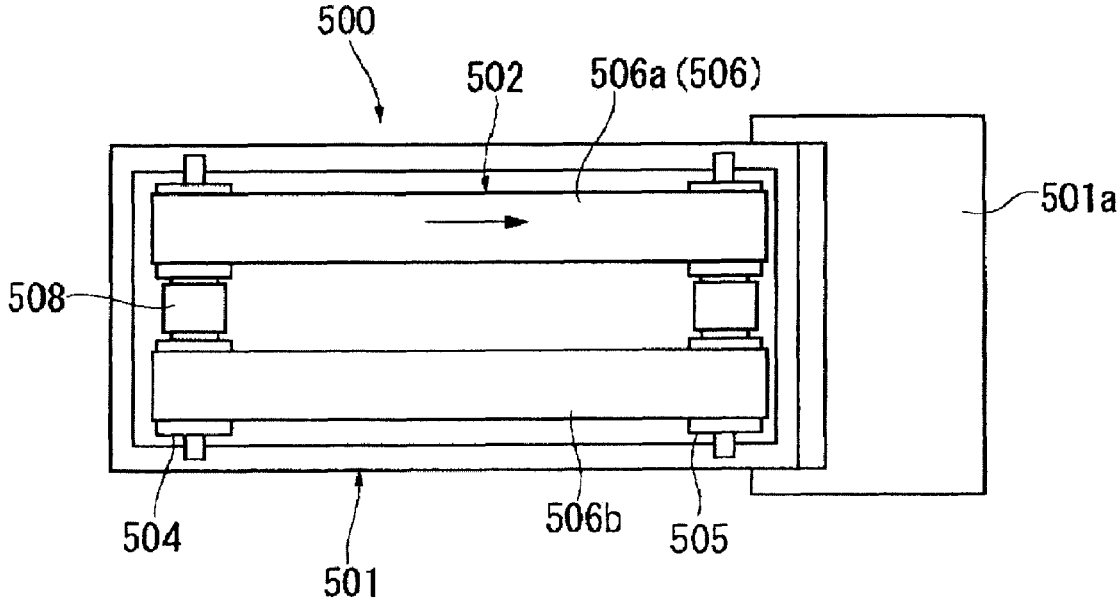

FIGS. 10A and 10B show an outline of the booklet accommodating unit 500; FIG. 10A is a view taken from the front, and FIG. 10B is a view taken from the above. In these figures, the belt roll 502 according to this exemplary embodiment is formed of belt members 506 (506*a* and 506*b*) stretched between two bridging rolls 504 and 505 separately disposed at two positions. Furthermore, a belt member 508 is stretched between the bridging roll 504 and a bridging roll (drive roll) 507 disposed below the bridging roll 504 at the nearly central position between the two belt members 506*a* and 506*b*. The two belt members 506 are rotated by rotating this bridging roll (drive roll) 507 using a motor (not shown) or the like. Moreover, in part of the support frame 501, the booklet accommodating unit 500 has an inclined unit 501*a* being inclined upward along the movement direction of the booklet from the periphery of the end of the belt roll 502 on the downstream side in the upper movement direction thereof. The detector 503 for detecting whether the booklet is present is not shown in the figure.

Figure 11A:
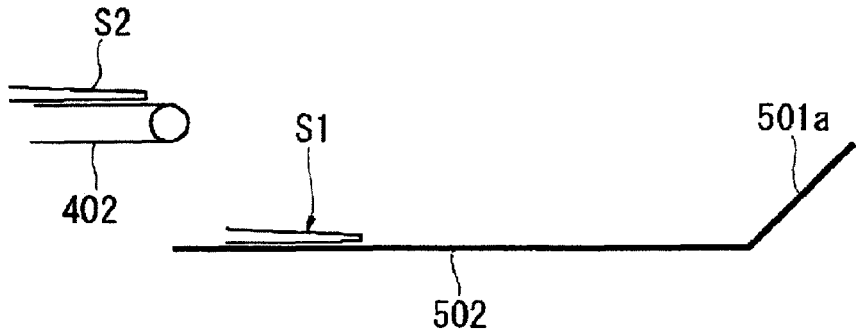
FIGS. 11A, 11B, 11C, and 11D are explanatory views showing how booklets are accommodated in the booklet accommodating unit.
Figure 11B:
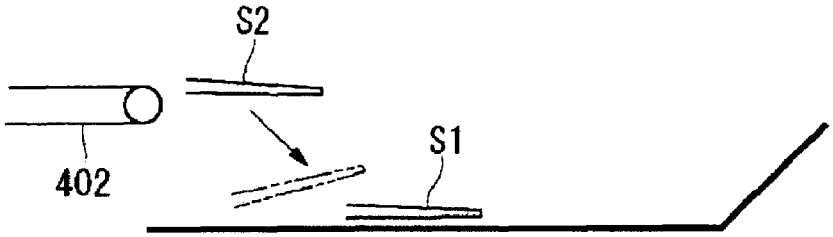
Figure 11C:
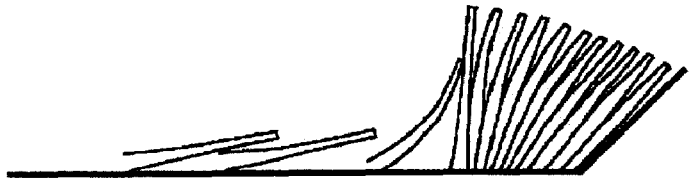
Figure 11D:
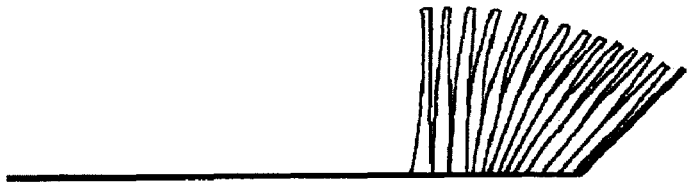

For the purpose of accommodating the booklets into the booklet accommodating unit 500 configured as described above, the following steps shown in FIGS. 11A to 11D are performed. More specifically, a first booklet S1 from among the booklets being conveyed using the belt roll 402 on the side of the trimming unit 400 is placed on the belt roll 502 of the booklet accommodating unit 500, and then the belt roll 502 is stopped at a predetermined position. When a subsequent booklet S2 drops to the belt roll 502, the subsequent booklet S2 is placed onto the first booklet S1 so that part of which overlaps with the first booklet S1. This procedure is repeated hereafter. Since the rotation/stop of the belt roll 502 is repeated as described above, the booklets are pushed toward the inclined unit 501*a* of the booklet accommodating unit 500 in the order beginning with the first booklet S1. At the inclined unit 501*a*, the back portions of the booklets are gradually oriented upward along the inclination of the inclined unit 501*a*, and the subsequent booklets are overlaid on the preceding booklets one after another. As a result, the booklets are accommodated in the booklet accommodating unit 500; the first booklet is accommodated at the inclined unit 501*a* of the booklet accommodating unit 500, and the subsequent booklets are accommodated so as to be gradually oriented in nearly vertical directions while the back portions thereof are aligned so as to be oriented upward as shown in FIG. 11D.

Figure 12B:
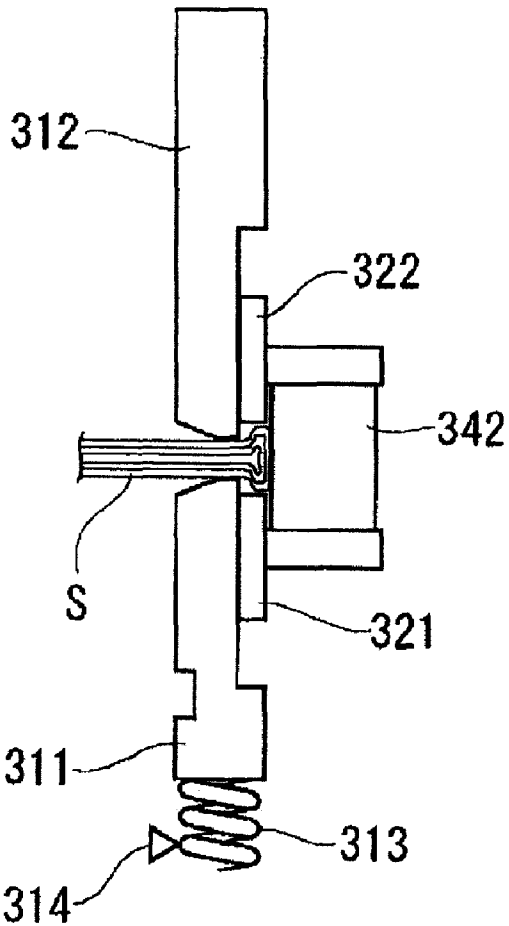
FIGS. 12A and 12B are explanatory views showing a processing method performed using the square folding unit.
Figure 12A:
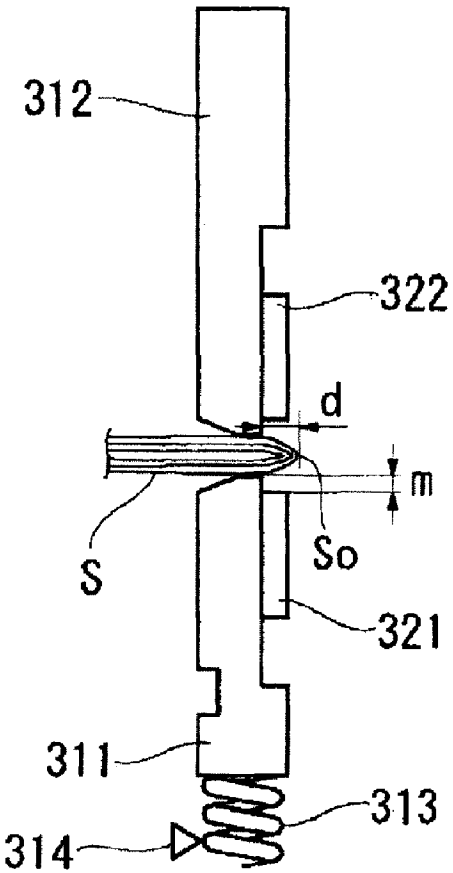

Next, the operation of the square folding unit 300, one of the features of this exemplary embodiment, will mainly be described below. FIG. 12A shows a state in which the booklet S is clamped using the two dampers 311 and 312. At this time, the distance (the protruding amount d of the back portion) from the dampers 311 and 312 to the position of the protruding end of the back portion $S_0$ of the booklet S is obtained depending on the judgment made with respect to the expanding amount of the booklet S, and the restricted position is adjusted using the protruding amount restricting unit (more specifically, the stopper), not shown, whereby the distance is finally determined. Furthermore, since the upper damper 312 presses the booklet S by exerting a predetermined pressing force at this time, the biasing member 313 for biasing the lower damper 311 is slightly lowered by this pressing force. This displacement amount (lowering amount) is detected using the potentiometer 314.

Next, in the case that the restrained booklet S is thick, the upper and lower relief amount adjusting members 321 and 322 are moved in the directions of increasing the relief amount on the basis of information regarding the replacement amount detected using the potentiometer 314, whereby the relief amount m is adjusted. After the protruding amount restricting unit (not shown) is withdrawn, the pressing roll 342 is moved in the vertical direction of the booklet S while crushing the back portion $S_0$ of the booklet S as shown in FIG. 12B. At this time, the crushed back portion $S_0$ of the booklet S is pressed and spread into the relief space formed using the relief amount adjusting members 321 and 322. As a result, the back portion $S_0$ of the booklet S is formed into a favorable square shape. In FIG. 12B, the pressing roll 342 is shown small so as to be recognized easily.

The relationship among the replacement amount of the biasing member 313, the protruding amount d of the back portion and the relief amount m when the booklet S is restrained using the dampers 311 and 312 is herein described in detail.

In this exemplary embodiment, the protruding amount d of the back portion is required to be determined before the booklet is restrained using the dampers 311 and 312. Hence, the protruding amount d of the back portion is first set to a predetermined value on the basis of the expanding amount of the booklet before it is restrained. At this time, for example, in the case that the expanding amount of the booklet is large (corresponding to the case that the booklet is thick), the protruding amount d of the back portion may be set to a large value because it is necessary for the back portion to securely have sufficient deformation. On the other hand, in the case that the expanding amount is small (corresponding to the case that the booklet is thin), the protruding amount d of the back portion may be set to a small value.

Figure 13A:
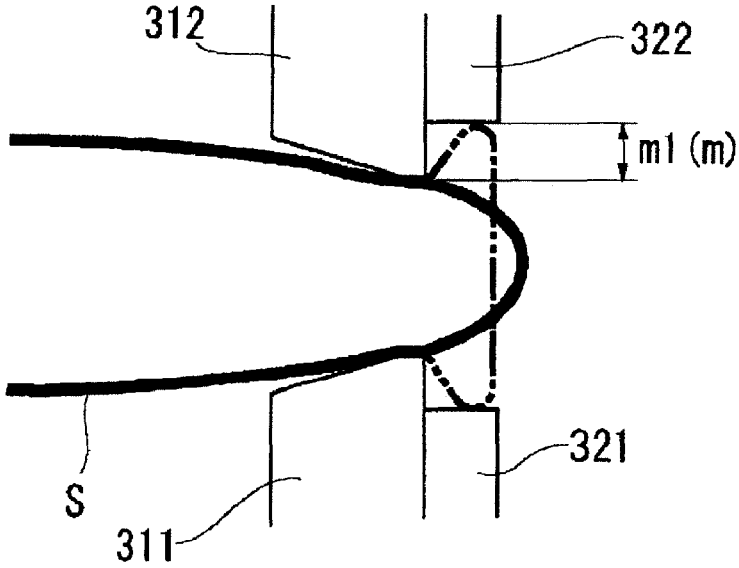
FIG. 13A is an explanatory view showing the relationship between the thickness of a booklet and a relief amount in the case that the relief amount is proper.
Figure 13B:
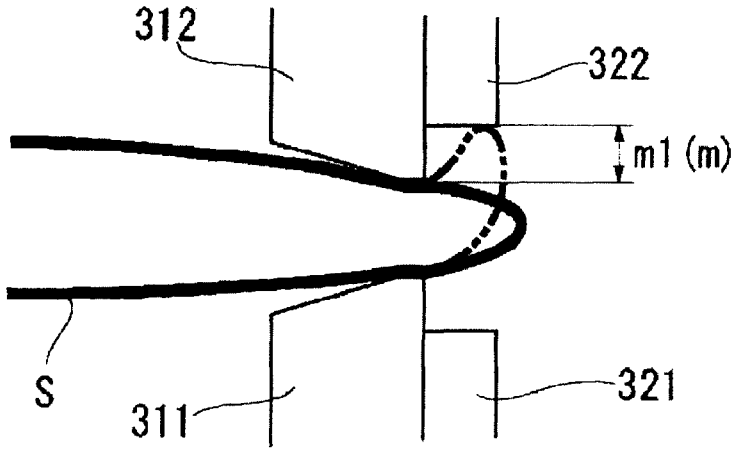
FIG. 13B is an explanatory view showing the relationship in the case that the relief amount is too large.

Next, the relief amount m is adjusted using the relief amount adjusting members 321 and 322 to securely obtain relief space in the case that the back portion of the restrained booklet is crushed using the clampers 311 and 312. In the case that the booklet S is thick as shown in FIG. 13A, a sufficient relief amount m1 (m) is required as indicated using an alternate long and two short dashed line in the figure when the back portion of the booklet S is crushed. However, if the relief amount m1 (m) is too large at this time, the deformed shape of the booklet S cannot be supported using the relief amount adjusting members 321 and 322, and it is difficult to form the back portion of the booklet S into a uniform square shape along the thickness direction of the booklet. FIG. 13B shows how the crushed back portion of the booklet is deformed in the case that the booklet is thin and the relief amount m1 is set to a large value. In this case, the back portion is deformed as indicated by an alternate long and two short dashed line in the figure, whereby it is difficult to form the back portion into a favorable square shape and the back portion may be wrinkled. However, since the relief amount m is adjusted depending on the thickness of the booklet S restrained using the dampers 311 and 312 in this exemplary embodiment, the back portion of the booklet is formed into a favorable square shape.

The relationship between the thickness of the booklet and the deformation amount is herein described. In this exemplary embodiment, when the relief amount m is adjusted, the thickness of the booklet is obtained on the basis of the displacement amount detected using the potentiometer 314. Since a predetermined pressing force is applied to the upper clamper 312 in this exemplary embodiment, the displacement amount increases as the thickness of the booklet is larger. In other words, the lowering amount of the lower clamper 311 pressed using the upper damper 312 becomes equal to the replacement amount.

However, it is conceivable that the displacement amount is different depending on not only the thickness of the booklet but also the quality of recording material. In other words, in the case that sheets of sturdy recording material are used, the displacement amount becomes larger than that in the case that sheets of flimsy recording material are used. In the case that such sheets of sturdy recording material are used, the back portion is formed into a favorable square shape by increasing the relief amount m so that adequate space is provided to allow sufficient deformation. More specifically, the back portion can be formed into a favorable square shape depending on the number of sheets of recording material and the quality of recording material by measuring the displacement amount of the back portion of the restrained booklet and by adjusting the relief amount m depending on the displacement amount in consideration of the quality of recording material.

The protruding amount d of the back portion and the relief amount m are adjusted so as to be larger as the expanding amount is larger. However, in this case, the amounts may be changed continuously or stepwise as the expanding amount is changed.

In this exemplary embodiment, the relief amount adjusting members 321 and 322 having a thickness of approximately 3 mm are used. However, the present invention is not limited to this configuration. In addition, the protruding amount of the back portion from the relief amount adjusting members 321 and 322, serving as the protruding amount d of the back portion of the booklet, is up to approximately 5 mm, and the relief amount m is up to approximately 0.6 mm. Although it is generally difficult to accurately adjust the amounts to these values, they can be adjusted with greater accuracy by ingeniously designing the movement mechanism of the stopper 333 of the protruding amount restricting unit 330 and the movement mechanisms of the relief amount adjusting members 321 and 322. The substantial protruding amount of the back portion may be obtained previously through experiments in consideration of the shape of the pressing roll, for example.

In this exemplary embodiment, the expanding amount of the booklet is obtained on the basis of information regarding the number of sheets of recording material and the quality of recording material, and the position (for restricting the protruding amount d of the back portion) of the stopper 333 against which the back portion of the booklet is struck is determined. Furthermore, after the booklet is restrained using the clampers 311 and 312, the relief amount m is determined using the relief amount adjusting members 321 and 322 on the basis of the displacement amount (corresponding to the expanding amount of the booklet) of the lower damper 311. Hence, it is possible to form the back portion of the booklet into a square shape more stably.

In this exemplary embodiment, a system is described in which the position of the stopper 333 and the positions of the relief amount adjusting members 321 and 322 are obtained on the basis of information regarding the different expanding amounts of the booklets. However, it may be possible to use a system in which the relief amount m is obtained through various kinds of experiments or the like, the position of the stopper 333 and the positions of the relief amount adjusting members 321 and 322 are adjusted on the basis of the expanding amount of the booklet before the booklet is restrained using the dampers 311 and 312, and the protruding amount d of the back portion and the relief amount m are determined simultaneously. The accuracy in this system is slightly lower than that in the system in which the relief amount m is determined after the booklet is restrained. However, in this system, the back portion of the booklet is formed into a square shape far better than that in the conventional system in which the relief amount m is unchanged.

Moreover, it may be possible that the protruding amount d of the back portion is set to a predetermined value and that only the relief amount m is adjusted on the basis of the displacement amount (corresponding to the expanding amount) of the restrained booklet. In this case, the back portion of the booklet is formed into a square shape better than that in the case in which the relief amount m is fixed.

Figure 14B:
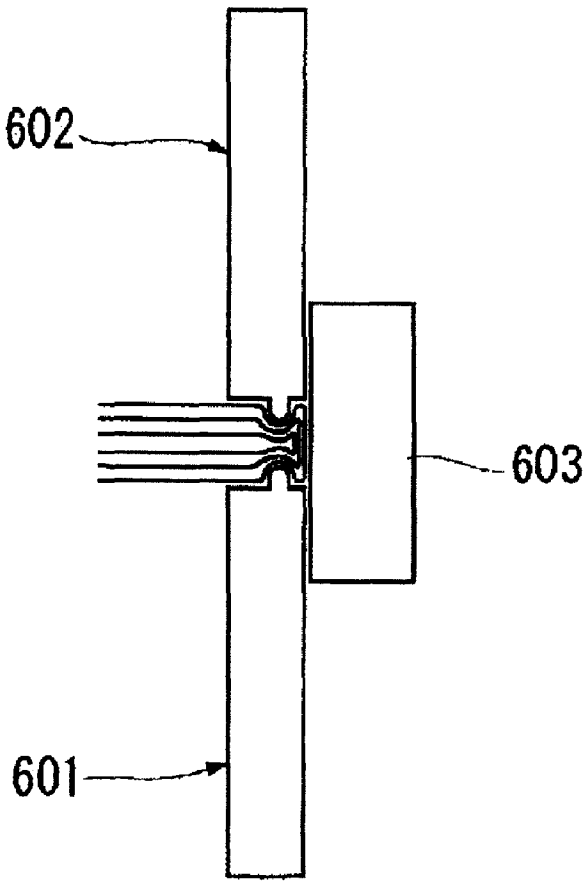
FIGS. 14A and 14B are explanatory views showing square folding processing performed using a comparative model.
Figure 14A:
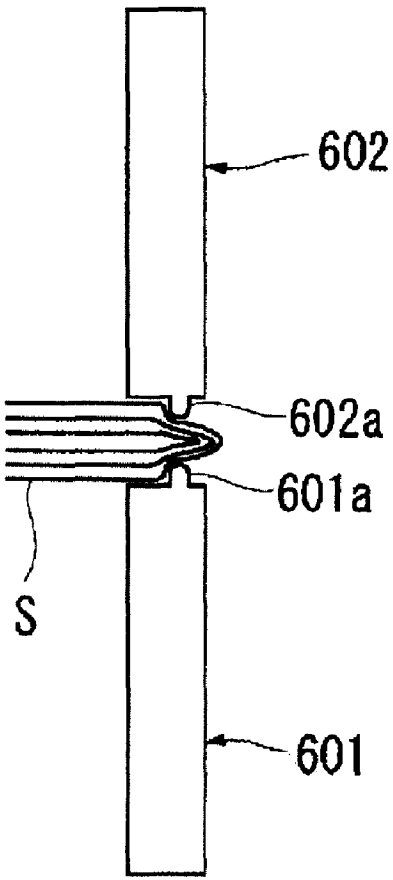

FIGS. 14A and 14B show the configuration of a comparative model to be compared with this exemplary embodiment. In the comparative model, protruding units 601*a* and 602*a* are partly formed on the booklet restraining faces of dampers 601 and 602, respectively, to restrain the booklet S and to form relief space. In this kind of system, the booklet S is first set so that the protruding amount of the back portion of the booklet S has a predetermined value and the booklet is restrained using the dampers 601 and 602 as shown in FIG. 14A. Next, a pressing roll 603 is pressed against the back portion of the booklet and moved in the vertical direction as shown in FIG. 14B. Since relief space is formed using the protruding units 601*a* and 602*a* of the dampers 601 and 602 at this time, the crushed back portion of the booklet is deformed along the contour of the relief space. However, since the relief space is formed using the protruding units 601*a* and 602*a* originally serving as parts of the dampers 601 and 602, constant space is formed as the relief space at all times, and the relief space cannot be adjusted. For this reason, the relief space becomes too narrow or wide depending on the booklet to be processed, and the back portion of the booklet cannot be formed into a favorable square shape.

On the other hand, in this exemplary embodiment, since the relief amount m is adjusted depending on the booklet to be processed, the back portion of the booklet is form into a favorable square shape.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A post-processing apparatus for a booklet which is a bundle of half-folded sheets of recording material and of which a back portion protrudes, comprising:

a restraining unit that restrains a periphery of the back portion of the booklet;

a pressing unit that presses the back portion of the booklet restrained by restraining unit so that a curved back face of the back portion of the booklet is formed into a flat back face;

an expanding amount judging unit that judges the expanding amount of the booklet in a thickness direction thereof before the pressing operation by the pressing unit; and a relief amount adjusting unit that, based on the judgment result of the expanding amount judging unit, adjusts a deformation amount of the back portion of the booklet in the thickness direction thereof caused by the pressing operation of the pressing unit, the relief amount adjusting unit being located between the restraining unit and the pressing unit.

2. The post-processing apparatus according to claim 1, wherein the relief amount adjusting unit has relief amount adjusting members that is disposed adjacent to the restraining unit and movable along the thickness direction of the booklet, and positions of the relief amount adjusting members are moved based on the judgment result of the expanding amount judging unit.

3. The post-processing apparatus according to claim 2, wherein the restraining unit has a pair of restraining members that hold the booklet in the thickness direction thereof, and the relief amount adjusting members are provided to be slidably movable along faces of the restraining members on a side of the back portion of the booklet among faces of the restraining members being nearly perpendicular to restrained faces of the booklet.

4. The post-processing apparatus according to claim 3, wherein the relief amount adjusting unit adjusts the relief amount by moving the relief amount adjusting members obliquely with respect to the vertical direction of the restrained booklet.

5. The post-processing apparatus according to claim 3, wherein the pair of the restraining members has guide faces inclined so that the space therebetween becomes narrow along am insertion direction of the booklet on a side where the back portion of the booklet is inserted when the booklet is restrained by the restraining members.

6. The post-processing apparatus according to claim 3, wherein the pressing unit has a roll-shaped pressing member that presses the back portion of the booklet being located at a restraining position of the booklet so that the curved back face of the back portion of the booklet is formed into the flat back face, and the pressing member, when the booklet is pressed by the pressing member, is moved along the back portion of the booklet while making contact with the relief amount adjusting members or the restraining members.

7. The post-processing apparatus according to claim 1, further comprising:

a protruding amount restricting unit that, when the expanding amount judging unit judges the expanding amount of the booklet before the booklet is restrained by the restraining unit, restricts a protruding amount of the back portion protruding from the restraining position of the booklet position by the restraining unit according to the judgment result of the expanding amount judging unit.

8. The post-processing apparatus according to claim 7, wherein the protruding amount restricting unit includes a protruding amount restricting member that is provided to be movable along a protruding direction of the back portion of the booklet protruding from the restraining position of the booklet by the restraining unit, and the protruding amount restricting member, when the booklet is pressed by pressing unit, is withdrawn to a position where the protruding amount restricting member does not interfere with the pressing unit and restricts the position of the back portion of the booklet corresponding to the restraining position.

9. The post-processing apparatus according to claim 8, further comprising:

a booklet conveying unit that conveys the booklet so that the booklet is conveyed until the back portion of the booklet reaches the position where the back portion of the booklet is to be restricted by the protruding amount restricting unit, wherein the booklet conveying unit, after the back portion of the booklet is struck against the protruding amount restricting member so that the position of the back portion is restricted, stops or idly operates while the back portion of the booklet is retained at the restricted position.

10. The post-processing apparatus according to claim 1, further comprising:

a information inputting unit that inputs information indicating the number of sheets of recording material included in the booklet, wherein the an expanding amount judging unit judges the expanding amount of the booklet in a thickness direction thereof based on the input information.

11. The post-processing apparatus according to claim 1, wherein the deformation amount of the back portion of the booklet in the thickness direction is a deformation amount of a portion caught between the restraining unit and the pressing unit.

* * * * *